US008636478B2

(12) United States Patent
Heller et al.

(10) Patent No.: US 8,636,478 B2
(45) Date of Patent: Jan. 28, 2014

(54) SENSOR ASSEMBLY FOR DETERMINING FLUID PROPERTIES IN A SUBSURFACE WELL

(75) Inventors: Noah R. Heller, Corte Madera, CA (US); Peter F. Moritzburke, Corte Madera, CA (US)

(73) Assignee: BESST, Inc., San Rafael, CA (US)

( * ) Notice: Subject to any disclaimer, the term of this patent is extended or adjusted under 35 U.S.C. 154(b) by 1172 days.

(21) Appl. No.: 11/651,649

(22) Filed: Jan. 9, 2007

(65) Prior Publication Data

US 2007/0169933 A1 Jul. 26, 2007

Related U.S. Application Data

(60) Provisional application No. 60/758,030, filed on Jan. 11, 2006, provisional application No. 60/765,249, filed on Feb. 3, 2006.

(51) Int. Cl.
*F04B 49/00* (2006.01)

(52) U.S. Cl.
USPC ..... 417/63

(58) Field of Classification Search
USPC ..... 417/63, 423.3, 394–395, 904; 166/264, 166/250.03, 250.15
See application file for complete search history.

(56) References Cited

U.S. PATENT DOCUMENTS 2,128,253 A 8/1937 Johnson
2,137,296 A 11/1938 Macready
2,190,250 A 2/1940 Blackburn
2,227,539 A 1/1941 Dorton
2,703,144 A 3/1955 Clifford
2,776,013 A 1/1957 Tausch
2,946,387 A 7/1960 Hooker
3,022,828 A 2/1962 Hodges (Continued)

OTHER PUBLICATIONS

U.S. Appl. No. 11/178,055, filed Jul. 8, 2005, entitled "Systems and Methods for Installation, Design and Operation of Groundwater Monitoring Systems in Boreholes".

(Continued)

*Primary Examiner* — Devon Kramer
*Assistant Examiner* — Amene Bayou
(74) *Attorney, Agent, or Firm* — Roeder & Broder LLP; James P. Broder

(57) ABSTRACT

A sensor assembly (51) for sensing one or more fluid properties of a fluid in a subsurface well (12) having a well fluid level (42W), a surface region (32) and a riser pipe (30) includes a sensor apparatus (52) and a pump assembly (54) that are positioned within the well (12). The sensor apparatus (52) includes a sensor (682) that senses one of the fluid properties. The pump assembly (54) can be positioned in an in-line manner relative to the sensor apparatus (52). The pump assembly (54) can be positioned between the sensor apparatus (52) and the surface region (32). Alternatively, the sensor apparatus (52) can be positioned between the pump assembly (54) and the surface region (32). In one embodiment, the sensor apparatus (52) is positioned above the well fluid level (42W). The pump assembly (54) can pump fluid toward the sensor apparatus (52) or the pump assembly (54) can pump fluid to draw more fluid to the sensor apparatus (52). The pump assembly (54) can be a two-line, two-valve pump that is removable from the riser pipe (30). The sensor assembly (51) can include a controller (17) that receives data from the sensor (682) regarding one of the fluid properties of the fluid.

26 Claims, 7 Drawing Sheets

(56) References Cited

U.S. PATENT DOCUMENTS

| | | | | |
|---|---|---|---|---|
| 3,152,639 | A | 10/1964 | Pearcy | |
| 3,969,937 | A | 7/1976 | Barrington et al. | |
| 4,475,595 | A | 10/1984 | Watkins et al. | |
| 4,489,779 | A | 12/1984 | Dickinson | |
| 4,690,214 | A * | 9/1987 | Wittrisch | 166/250.17 |
| 4,701,107 | A | 10/1987 | Dickinson | |
| 4,724,434 | A * | 2/1988 | Hanson et al. | 340/854.5 |
| 4,942,923 | A | 7/1990 | Geeting | |
| 4,995,456 | A | 2/1991 | Cornette et al. | |
| 5,186,048 | A * | 2/1993 | Foster et al. | 73/152.02 |
| 5,293,931 | A | 3/1994 | Nichols et al. | |
| 5,293,934 | A | 3/1994 | Burge et al. | |
| 5,450,900 | A | 9/1995 | Schalla et al. | |
| 5,473,939 | A * | 12/1995 | Leder et al. | 73/152.12 |
| 5,687,791 | A | 11/1997 | Beck et al. | |
| 5,708,220 | A | 1/1998 | Burge | |
| 5,829,520 | A | 11/1998 | Johnson | |
| 5,892,860 | A * | 4/1999 | Maron et al. | 385/12 |
| 5,909,773 | A | 6/1999 | Koehler et al. | |
| 5,934,374 | A * | 8/1999 | Hrametz et al. | 166/264 |
| 6,158,516 | A | 12/2000 | Smith et al. | |
| 6,301,959 | B1 | 10/2001 | Hrametz et al. | |
| 6,508,310 | B1 * | 1/2003 | Mioduszewski et al. | 166/373 |
| 6,619,931 | B2 | 9/2003 | Anderson | |
| 6,659,174 | B2 * | 12/2003 | Hogan | 166/250.01 |
| 6,668,943 | B1 | 12/2003 | Maus et al. | |
| 6,722,432 | B2 | 4/2004 | Spiers et al. | |
| 6,745,835 | B2 * | 6/2004 | Fields | 166/264 |
| 6,935,356 | B2 | 8/2005 | Shepard et al. | |
| 6,962,197 | B2 * | 11/2005 | Khomynets | 166/254.2 |
| 7,004,252 | B2 | 2/2006 | Vise, Jr. | |
| 7,111,682 | B2 | 9/2006 | Blaisdell | |
| 7,320,364 | B2 | 1/2008 | Fairbanks | |
| 7,461,547 | B2 | 12/2008 | Terabayashi et al. | |
| 2002/0003038 | A1 * | 1/2002 | Bussear et al. | 166/66.6 |
| 2002/0053438 | A1 | 5/2002 | Williamson, Jr. | |
| 2002/0166663 | A1 * | 11/2002 | Last et al. | 166/250.03 |
| 2003/0127227 | A1 | 7/2003 | Fehr et al. | |
| 2003/0192697 | A1 * | 10/2003 | Grubb et al. | 166/305.1 |
| 2004/0050548 | A1 | 3/2004 | Dybdahl | |
| 2004/0134663 | A1 | 7/2004 | Khomynets | |
| 2005/0028974 | A1 * | 2/2005 | Moody | 166/264 |
| 2005/0051329 | A1 | 3/2005 | Blaisdell | |
| 2005/0224229 | A1 | 10/2005 | Blacklaw | |
| 2007/0199691 | A1 | 8/2007 | Heller et al. | |

OTHER PUBLICATIONS

San Diego Plastics, Inc., http://www.sdplastics.com/pvc.html, Jan. 21, 1997. Web page is unavailable.

* cited by examiner

SENSOR ASSEMBLY FOR DETERMINING FLUID PROPERTIES IN A SUBSURFACE WELL

RELATED APPLICATIONS

This Application claims the benefit on U.S. Provisional Application Ser. No. 60/758,030 filed on Jan. 11, 2006, and on U.S. Provisional Application Ser. No. 60/765,249 filed on Feb. 3, 2006. The contents of U.S. Provisional Application Ser. Nos. 60/758,030 and 60/765,249 are incorporated herein by reference.

BACKGROUND

Subsurface wells for extracting and/or testing fluid (liquid or gas) samples on land and at sea have been used for many years. Many structures have been developed in an attempt to isolate the fluid from a particular depth in a well so that more accurate in situ or remote laboratory testing of the fluid at that depth "below ground surface" (bgs) can be performed. Unfortunately, attempts to accurately and cost-effectively accomplish this objective have been not altogether satisfactory.

For example, typical wells include riser pipes having relatively large diameters, i.e. 2-4 inches, or greater. Many such wells can have depths that extend hundreds or even thousands of feet bgs. In order to accurately remove a fluid sample for testing from a particular target zone within a well, such as a sample at 1,000 feet bgs, typical wells can require that the fluid above the target zone be removed at least once and more commonly 3 to 5 times this volume in order to obtain a more representative fluid sample from the desired level. From a volumetric standpoint, traditional wet casing volumes of 2-inch and 4-inch monitoring wells are 0.63 liters (630 ml) to 2.5 liters (2,500 ml) per foot, respectively. As an example, to obtain a sample at 1,000 feet bgs, approximately 630 liters to 2,500 liters of fluid must be purged from the well at least once and more commonly 3 to 5 times this volume. The time required and costs associated with extracting this fluid from the well can be rather significant.

One method of purging fluid from the well and/or obtaining a fluid sample includes using coaxial gas displacement within the riser pipe of the well. Unfortunately, this method can have several drawbacks. First, gas consumption during pressurization of these types of systems can be relatively substantial because of the relatively large diameter and length of riser pipe that must be pressurized. Second, introducing large volumes of gas into the riser pipe can potentially have adverse effects on the volatile organic compounds (VOC's) being measured in the fluid sample that is not collected properly. Third, a pressure sensor that may be present within the riser pipe of a typical well is subjected to repeated pressure changes from the coaxial gas displacement pressurization of the riser pipe. Over time, this artificially-created range of pressures in the riser pipe may have a negative impact on the accuracy of the pressure measurements from the sensor. Fourth, residual gas pressure can potentially damage one or more sensors and/or alter readings from the sensors once substantially all of the fluid has passed through the sample collection line past the sensors. Fifth, any leaks in the system can cause gas to be forcibly infused into the ground formation, which can influence the results of future sample collections.

Another method for purging fluid from these types of wells includes the use of a bladder pump. Bladder pumps include a bladder that alternatingly fills and empties with a gas to force movement of the fluid within a pump system. However, the bladders inside these pumps can be susceptible to leakage due to becoming fatigued or detached during pressurization. Further, the initial cost as well as maintenance and repair of bladder pumps can be relatively expensive. In addition, at certain depths, bladder pumps require an equilibration period during pressurization to decrease the likelihood of damage to or failure of the pump system. This equilibration period can result in a slower overall purging process, which decreases efficiency.

An additional method for purging fluid from a well includes using an electric submersible pump system having an electric motor. This type of system can be susceptible to electrical shorts and/or burning out of the electric motor. Additionally, this type of pump typically uses one or more impellers that can cause pressure differentials (e.g., drops), which can result in VOC loss from the sample being collected. Operation of these types of electric pumps can also raise the temperature of the groundwater, which can also impact VOC loss. Moreover, these pumps can be relatively costly and somewhat more difficult to repair and maintain.

Further, the means for physically isolating a particular zone of the well from the rest of the well can have several shortcomings. For instance, inflatable packers are commonly used to isolate the fluid from a particular zone either above or below the packer. However, these types of packers can be subject to leakage, and can be cumbersome and relatively expensive. In addition, these packers are susceptible to rupturing, which can potentially damage the well.

SUMMARY

The present invention is directed toward a sensor assembly for sensing one or more fluid properties of a fluid in a subsurface well. One of the fluid properties can be selected from the group consisting of an electrical property, an optical property, an acoustical property, a chemical property and a hydraulic property. The subsurface well has a well fluid level, a surface region and a riser pipe that extends in a downwardly direction from the surface region. In certain embodiments, the sensor assembly includes a sensor apparatus and a pump assembly. The sensor apparatus is positioned within the subsurface well, and includes a sensor that senses one of the fluid properties of the fluid.

The pump assembly is coupled to the sensor apparatus. The pump assembly can be positioned within the subsurface well in an in-line manner relative to the sensor apparatus. In one embodiment, the pump assembly can pump fluid toward the sensor apparatus. In an alternative embodiment, the pump assembly can pump fluid in order to draw more fluid to the sensor apparatus so that the sensor can sense one or more of the fluid properties of the fluid. In various embodiments, the pump assembly is removable from the riser pipe of the subsurface well. Further, the pump assembly can include a two-line, two-valve pump.

In certain embodiments, the pump assembly is positioned substantially between the sensor apparatus and the surface region. In one such embodiment, at least a portion of the pump assembly is positioned below the well fluid level within the subsurface well. In alternative embodiments, the sensor apparatus can be positioned between the pump assembly and the surface region of the subsurface well. In these embodiments, the pump assembly is adapted to pump fluid to the sensor apparatus. In one such embodiment, the sensor apparatus can be positioned above the well fluid level within the subsurface well.

In another embodiment, the sensor assembly also includes a controller that receives data from the sensor regarding one of the fluid properties of the fluid. The data can be transmitted to the controller while the sensor is positioned within the subsurface well.

The present invention is also directed toward a method for sensing one or more fluid properties from a fluid within a subsurface well.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
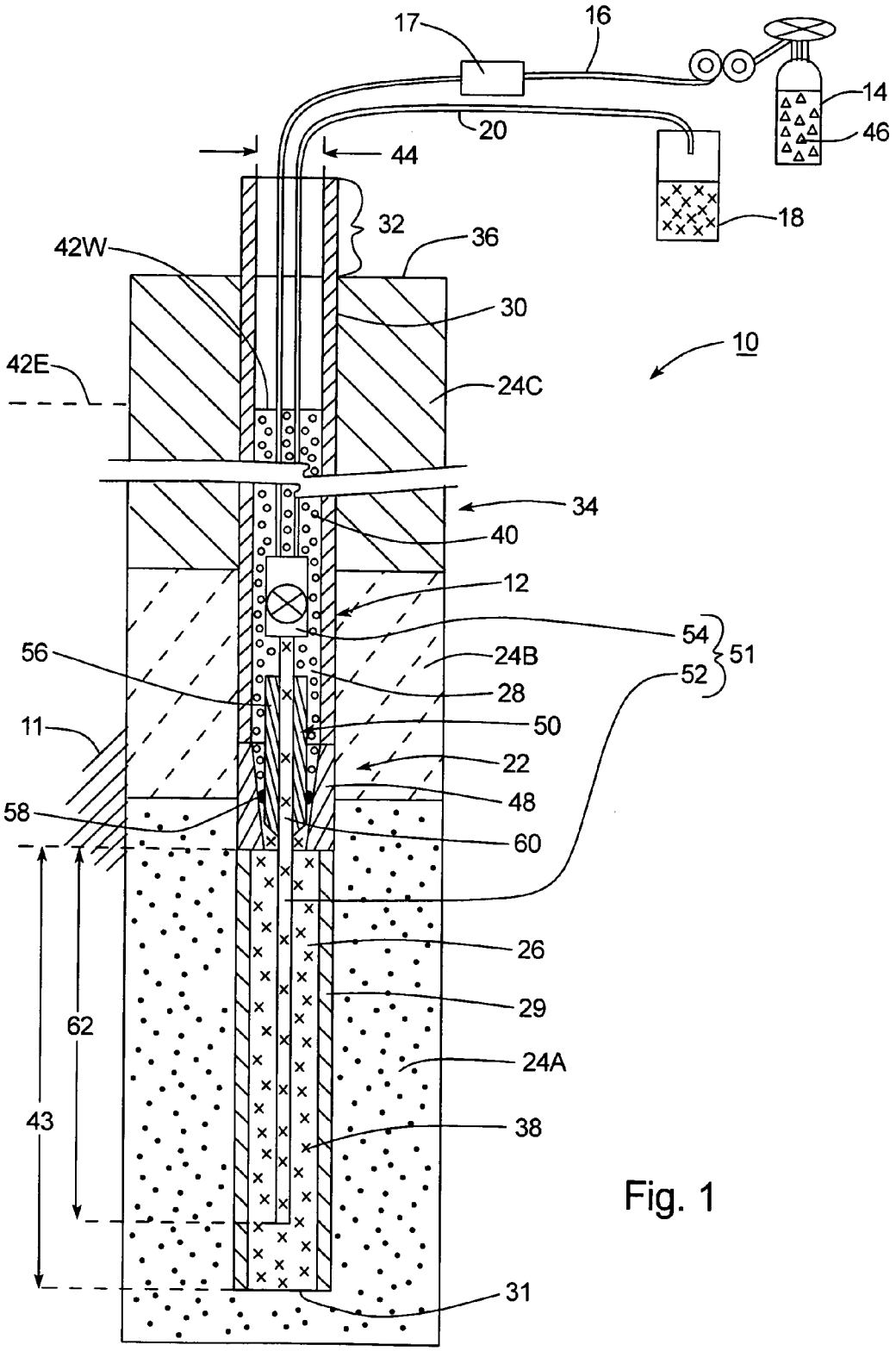
FIG. 1 is a cross-sectional view of one embodiment of a fluid monitoring system having features of the present invention, including one embodiment of a zone isolation assembly.

FIG. 1 is a schematic view of one embodiment of a fluid monitoring system 10 for monitoring or sensing one or more parameters of subsurface fluid from an adjacent environment 11. As used herein, the term "environment" can include naturally occurring or artificial (manmade) environments 11 of either solid or liquid materials. As non-exclusive examples, the environment 11 can include a ground formation of soil, rock or any other types of solid formations, or the environment 11 can include a portion of a body of water (ocean, lake, river, etc.) or other liquid regions.

Monitoring the fluid in accordance with the present invention can be performed in situ or following removal of the fluid from its native or manmade environment 11. As used herein, the term "monitoring" or "sensing" can include a one-time measurement of a single parameter of the fluid, multiple or ongoing measurements of a single parameter of the fluid, a one-time measurement of multiple parameters of the fluid, or multiple or ongoing measurements of multiple parameters of the fluid. Further, it is recognized that subsurface fluid can be in the form of a liquid and/or a gas. In addition, the Figures provided herein are not to scale given the extreme heights of the fluid monitoring systems relative to their widths.

The fluid monitoring system 10 illustrated in FIG. 1 can include a subsurface well 12, a gas source 14, a gas inlet line 16, a controller 17, a fluid receiver 18, a fluid outlet line 20 and a zone isolation assembly 22. In this embodiment, the subsurface well 12 (also sometimes referred to herein simply as "well") can include one or more layers of annular materials 24A, 24B, 24C, a first zone 26, a second zone 28, a fluid inlet structure 29, and/or a riser pipe 30. It is understood that although the fluid monitoring systems 10 described herein are particularly suited to be installed in the ground, various embodiments of the fluid monitoring systems 10 are equally suitable for installation and use in a body of water, or in a combination of both ground and water, and that no limitations are intended in any manner in this regard.

The subsurface well 12 can be installed using any one of a number of methods known to those skilled in the art. In non-exclusive, alternative examples, the well 12 can be installed with hollow stem auger, sonic, air rotary casing hammer, dual wall percussion, dual tube, rotary drilling, vibratory direct push, cone penetrometer, cryogenic, ultrasonic and laser methods, or any other suitable method known to those skilled in the art of drilling and/or well placement. The wells 12 described herein include a surface region 32 and a subsurface region 34. The surface region 32 is an area that includes the top of the well 12 which extends to a surface 36. Stated another way, the surface region 32 includes the portion of the well 12 that extends between the surface 36 and the top of the riser pipe 30, whether the top of the riser pipe 30 is positioned above or below the surface 36. The surface 36 can either be a ground surface or the surface of a body of water or other liquid, as non-exclusive examples. The subsurface region 34 is the portion of the well 12 that is below the surface region 32, e.g., at a greater depth than the surface region 34.

The annular materials 24A-C can include a first layer 24A (illustrated by dots) that is positioned at or near the first zone 26, and a second layer 24B (illustrated by dashes) that is positioned at or near the second zone 28. The annular materials are typically positioned in layers 24A-C during installation of the well 12. It is recognized that although three layers 24A-C are included in the embodiment illustrated in FIG. 1, greater or fewer than three layers 24A-C of annular materials can be used in a given well 12.

In one embodiment, for example, the first layer 24A can be sand or any other suitably permeable material that allows fluid to move from the surrounding ground environment 11 to the fluid inlet structure 29 of the well 12. The second layer 24B is positioned above the first layer 24A. The second layer 24B can be formed from a relatively impermeable layer that inhibits migration of fluid from the environment 11 near the fluid inlet structure 29 and the first zone 26 to the riser pipe 30 and the second zone 28. For example, the second layer 24B can include a bentonite material or any other suitable material of relative impermeability. In this embodiment, the second layer 28 helps increase the likelihood that the fluid collected through the fluid inlet structure 29 of the well 12 is more representative of the fluid from the environment 11 adjacent to the fluid inlet structure 29. The third layer 24C is positioned above the second layer 24B and can be formed from any suitable material, such as backfilled grout, bentonite, volclay and/or native soil, as one non-exclusive example. The third layer 24C is positioned away from the first layer 24A to the extent that the likelihood of fluid migrating from the environment 11 near the third layer 24C down to the fluid inlet structure 29 is reduced or prevented.

As used herein, the first zone 26 is a target zone from which a particular fluid sample is desired to be taken and/or monitored. Further, the second zone 28 can include fluid that is desired to be excluded from the fluid sample to be removed from the well 12 and/or tested, and is adjacent to the first zone 26. In the embodiments provided herein, the first zone 26 is positioned either directly beneath or at an angle below the second zone 28 such that the first zone 26 is further from the surface 36 of the surface region 32 than the second zone 28.

In each well 12, the first zone 26 has a first volume and the second zone 28 has a second volume. In certain embodiments, the second volume is substantially greater than the first volume because the height of the second zone 28 can be substantially greater than a height of the first zone 26. For example, the height of the first zone 26 can be on the order of between several inches to approximately five or ten feet. In contrast, the height of the second zone 28 can be from several feet up to several hundreds or thousands of feet. Assuming somewhat similar inner dimensions of the first zone 26 and the second zone 28, the second volume can be from 100% to 100,000% greater than the first volume. As one non-exclusive example, in a 1-inch inner diameter well 12 having a depth of 1,000 feet, with the first zone 26 positioned at the bottom of the well 12, the first zone having a height of approximately five feet, the second zone 28 would have a height of approximately 995 feet. Thus, the first volume would be approximately 47 $in^3$, while the second volume would be approximately 9,378 $in^3$, or approximately 19,800% greater than the first volume.

For ease in understanding, the first zone 26 includes a first fluid 38 (illustrated with X's), and the second zone 28 includes a second fluid 40 (illustrated with O's). The first fluid 38 and the second fluid 40 migrate as a single fluid to the well 12 through the environment 11 outside of the fluid inlet structure 29. In this embodiment, a well fluid level 42W in the well 12 is the top of the second fluid 40, which, at equilibrium, is approximately equal to an environmental fluid level 42E in the environment 11, although it is acknowledged that some differences between the well fluid level 42W and the environmental fluid level 42E can occur. During equilibration of the fluid levels 42W, 42E, the fluid rises in the first zone 26 and the second zone 28 of the well 12. Due to gravitational forces and/or other influences, the fluid near an upper portion (e.g., in the second zone 28) of the well 12 will have a different composition from the fluid near a lower portion (e.g., in the first zone 26) of the well 12. Thus, although the first fluid 38 and the second fluid 40 can originate from a somewhat similar location within the environment 11, the first fluid 38 and the second fluid 40 can ultimately have different compositions at a point in time after entering the well 12, based on the relative positions of the fluids 38, 40 within the well 12.

The first fluid 38 is the liquid or gas that is desired for monitoring and/or testing. In this and other embodiments, it is desirable to inhibit mixing or otherwise commingling of the first fluid 38 and the second fluid 40 before monitoring and/or testing the first fluid 38. As described in greater detail below, the first fluid 38 and the second fluid 40 can be effectively isolated from one another utilizing the zone isolation assembly 22.

The fluid inlet structure 29 allows fluid from the first layer 24A outside the first zone 26 to migrate into the first zone 26. The design of the fluid inlet structure 29 can vary. For example, the fluid inlet structure 29 can have a substantially tubular configuration or another suitable geometry. Further, the fluid inlet structure 29 can be perforated, slotted, screened or can have some other alternative openings or pores (not shown) that allow fluid and/or various particulates to enter into the first zone 26. The fluid inlet structure 29 can include an end cap 31 at the lowermost end of the fluid inlet structure 29 that inhibits material from the first layer 24A from entering the first zone 26.

The fluid inlet structure 29 has a length 43 that can vary depending upon the design requirements of the well 12 and the subsurface monitoring system 10. For example, the length 43 of the fluid inlet structure 29 can be from a few inches to several feet or more.

The riser pipe 30 is a hollow, cylindrically-shaped structure. The riser pipe 30 can be formed from any suitable materials. In one non-exclusive embodiment, the riser pipe 30 can be formed from a polyvinylchloride (PVC) material and can be any desired thickness, such as Schedule 80, Schedule 40, etc. Alternatively, the riser pipe 30 can be formed from other plastics, fiberglass, ceramic, metal, etc. The length (oriented substantially vertically in FIG. 1) of the riser pipe 30 can vary depending upon the requirements of the system 10. For example, the length of the riser pipe 30 can be within the range of a few feet to thousands of feet, as necessary. It is recognized that although the riser pipe 30 illustrated in the Figures is illustrated substantially vertically, the riser pipe 30 and other structures of the well 12 can be positioned at any suitable angle from vertical.

The inner diameter 44 of the riser pipe 30 can vary depending upon the design requirements of the well 12 and the fluid monitoring system 10. In one embodiment, the inner diameter 44 of the riser pipe 30 is less than approximately 2.0 inches. For example, the inner diameter 44 of the riser pipe 30 can be approximately 1.85 inches. In non-exclusive alternative embodiments, the inner diameter 44 of the riser pipe 30 can be approximately 1.40 inches, 0.90 inches, 0.68 inches, or any other suitable dimension. In still other embodiments, the inner diameter 44 of the riser pipe 30 can be greater than 2.0 inches.

The gas source 14 includes a gas 46 (illustrated with small triangles) that is used to move the first fluid 38 as provided in greater detail below. The gas 46 used can vary. For example, the gas 46 can include nitrogen, argon, oxygen, helium, air, hydrogen, or any other suitable gas. In one embodiment, the flow of the gas 46 can be regulated by the controller 17, which can be manually or automatically operated and controlled, as needed.

The gas inlet line 16 is a substantially tubular line that directs the gas 46 to the well 12 or to various structures and/or locations within the well 12, as described in greater detail below.

The controller 17 can control or regulate various processes related to fluid monitoring. For example, the controller 17 can adjust and/or control timing of the gas delivery to various structures within the well 12. Additionally, or alternatively, the controller 17 can adjust and/or regulate the volume of gas 46 that is delivered to the various structures within the well 12. In still other embodiments, the controller 17 can receive and/or analyze data that is transmitted to the controller 17 by other structures in the well 12, as described in greater detail below. For example, the controller can analyze data relating to the fluid properties of the fluid being analyzed and/or sampled in the well 12. In one embodiment, the controller 17 can include a computerized system. It is recognized that the positioning of the controller 17 within the fluid monitoring system 10 can be varied depending upon the specific processes being controlled by the controller 17. In other words, the positioning of the controller 17 illustrated in FIG. 1 is not intended to be limiting in any manner.

The fluid receiver 18 receives the first fluid 38 from the first zone 26 of the well 12. Once received, the first fluid 38 can be monitored, sensed and/or tested by methods known by those skilled in the art. Alternatively, the first fluid 38 can be monitored, sensed and/or tested prior to being received by the fluid receiver 18. The first fluid 38 is transferred to the fluid receiver 18 via the fluid outlet line 20. Alternatively, the fluid receiver 18 can receive a different fluid from another portion of the well 12.

The zone isolation assembly 22 selectively isolates the first fluid 38 in the first zone 26 from the second fluid 40 in the second zone 28. The design of the zone isolation assembly 22 can vary to suit the design requirements of the well 12 and the fluid monitoring system 10. In the embodiment illustrated in FIG. 1, the zone isolation assembly 22 includes a docking receiver 48, a docking apparatus 50 and a sensor assembly 51.

In the embodiment illustrated in FIG. 1, the docking receiver 48 is fixedly secured to the fluid inlet structure 29 and the riser pipe 30. In various embodiments, the docking receiver 48 is positioned between and threadedly secured to the fluid inlet structure 29 and the riser pipe 30. In non-exclusive alternative embodiments, the docking receiver 48 can be secured to the fluid inlet structure 29 and/or the riser pipe 30 in other suitable ways, such as by an adhesive material, welding, fasteners, or by integrally forming or molding the docking receiver 48 with one or both of the fluid inlet structure 29 and at least a portion of the riser pipe 30. Stated another way, the docking receiver 48 can be formed unitarily with the fluid inlet structure 29 and/or at least a portion of the riser pipe 30.

In certain embodiments, the docking receiver 48 is at least partially positioned at the uppermost portion of the first zone 26. In other words, a portion of the first zone 26 is at least partially bounded by the docking receiver 48. Further, the docking receiver 48 can also be positioned at the lowermost portion of the second zone 28. In this embodiment, a portion of the second zone 28 is at least partially bounded by the docking receiver 48.

The docking apparatus 50 selectively docks with the docking receiver 48 to form a substantially fluid-tight seal between the docking apparatus 50 and the docking receiver 48. The design and configuration of the docking apparatus 50 as provided herein can be varied to suit the design requirements of the docking receiver 48. In various embodiments, the docking apparatus 50 moves from a disengaged position wherein the docking apparatus 50 is not docked with the docking receiver 48, to an engaged position wherein the docking apparatus 50 is docked with the docking receiver 48.

In the disengaged position, the first fluid 38 and the second fluid 40 are not isolated from one another. In other words, the first zone 26 and the second zone 28 are in fluid communication with one another. In the engaged position (illustrated in FIG. 1), the first fluid 38 and the second fluid 40 are isolated from one another. Stated another way, in the engaged position, the first zone 26 and the second zone 28 are not in fluid communication with one another.

The docking apparatus 50 includes a docking weight 56, a resilient seal 58 and a fluid channel 60. In various embodiments, the docking weight 56 has a specific gravity that is greater than water. In non-exclusive alternative embodiments, the docking weight 56 can be formed from materials so that the docking apparatus has an overall specific gravity that is at least approximately 1.50, 2.00, 2.50, 3.00, or 3.50. In certain embodiments, the docking weight 56 can be formed from materials such as metal, ceramic, epoxy resin, rubber, Viton, Nylon, Nitrile, Teflon, glass, plastic or other suitable materials having the desired specific gravity characteristics.

In various embodiments, the resilient seal 58 is positioned around a circumference of the docking weight 56. The resilient seal 58 can be formed from any resilient material such as rubber, urethane or other plastics, certain epoxies, or any other material that can form a substantially fluid-tight seal with the docking receiver 48. In one non-exclusive embodiment, for example, the resilient seal 58 is a rubberized O-ring. In this embodiment, because the resilient seal 58 is in the form of an O-ring, a relatively small surface area of contact between the resilient seal 58 and the docking receiver 48 occurs. As a result, a higher force in pounds per square inch (psi) is achieved. For example, a fluid-tight seal between the docking receiver 48 and the resilient seal 58 can be achieved with a force that is less than approximately 1.00 psi. In non-exclusive alternative embodiments, the force can be less than approximately 0.75, 0.50, 0.40 or 0.33 psi. Alternatively, the force can be greater than 1.00 psi or less than 0.33 psi.

The fluid channel 60 can be a channel or other type of conduit for the first fluid 38 to move through the docking weight 56, in a direction from the first zone 26 toward the surface region 32. In one embodiment, the fluid channel 60 can be tubular and can have a substantially circular cross-section. Alternatively, the fluid channel 60 can have another suitable configuration. The positioning of the fluid channel 60 within the docking weight 56 can vary. In one embodiment, the fluid channel 60 can be generally centrally positioned within the docking weight 56 so that the first fluid 38 flows substantially centrally through the docking weight 56. Alternatively, the fluid channel 60 can be positioned in an off-center manner.

The docking apparatus 50 can be lowered into the well 12 from the surface region 32. In certain embodiments, the docking apparatus 50 utilizes the force of gravity to move down the riser pipe 30, through any fluid present in the riser pipe 30 and into the engaged position with the docking receiver 48. Alternatively, the docking apparatus 50 can be forced down the riser pipe 30 and into the engaged position by another suitable means.

The docking apparatus 50 is moved from the engaged position to the disengaged position by exerting a force on the docking apparatus 50 against the force of gravity, such as by pulling in a substantially upward manner, e.g., in a direction from the docking receiver 48 toward the surface region 32, on a tether or other suitable line coupled to the docking apparatus 50 to break or otherwise disrupt the seal between the resilient seal 58 and the docking receiver 48.

The sensor assembly 51 senses one or more fluid properties in the first fluid 38 or any other fluid in certain portions of the well 12. The sensing of fluid properties by the sensor assembly 51 can be performed in situ, which can save time and/or the expense normally required for the fluid purging process. Further, the sensor assembly 51 can transport or otherwise move the first fluid 38 or another fluid between points within the well 12 and/or from the well 12 to outside of the well 12, such as to the controller 17, the fluid receiver 18, or other suitable locations. The design of the sensor assembly 51 can vary to suit the design requirements of the fluid monitoring system 10.

In certain embodiments, the sensor assembly 51 includes a sensor apparatus 52 and a pump assembly 54. In the embodiment illustrated in FIG. 1, the pump assembly 54 operates to move the first fluid 38 through, along or around the sensor apparatus 52, as described in greater detail below. During this process, the sensor apparatus 52 can sense or otherwise determine one or more fluid properties of the first fluid 38. These fluid properties can include, as non-exclusive examples and without limitation, one or more of pressure, flow, refractive index, specific conductivity, temperature, oxidation-reduction potential, pH, dissolved oxygen, or any other suitable properties. In general terms, the fluid properties can include electrical properties, optical properties, acoustical properties, chemical properties and/or hydraulic properties. As provided herein, the sensor apparatus can then transmit data regarding the relevant fluid properties (sometimes referred to herein as "fluid property data") to the controller 17 for further processing and/or analysis, as required.

Once the relevant fluid properties have been sensed by the sensor apparatus 52, the pump assembly 54 can pump the first fluid 38 to the controller 17, the fluid receiver 18 or to another region of the fluid monitoring system 10, as required. In the embodiment illustrated in FIG. 1, the sensor apparatus 52 is secured to the docking apparatus 50 and extends in a downwardly direction into the first zone 26 when the docking apparatus 50 is in the engaged position. As provided previously, when the docking apparatus 50 is in the engaged position with the docking receiver 48, the first zone 26 is isolated from the second zone 28. Thus, because the sensor apparatus 52 is positioned within the first zone 26, in the engaged position, the sensor apparatus 52 senses or otherwise monitors only the first fluid 38.

The sensor apparatus 52 has a length 62 that can be varied to suit the design requirements of the first zone 26 and the fluid monitoring system 10. In certain embodiments, the sensor apparatus 52 extends substantially the entire length 43 of the fluid inlet structure 29. Alternatively, the length 62 of the sensor apparatus 52 can be any suitable percentage of the length 43 of the fluid inlet structure 29.

The pump assembly 54 pumps the first fluid 38 that enters the pump assembly 54 to the fluid receiver 18 via the fluid outlet line 20. The design and positioning of the pump assembly 54 can vary. In one embodiment, the pump assembly 54 is a highly robust, miniaturized low flow pump that can easily fit into a relatively small diameter wells 12, such as a 1-inch or ¾-inch riser pipe 30, although the pump assembly 54 is also adaptable to be used in larger diameter wells 12. Further, in various embodiments, the pump assembly 54, including all of its components, is completely removable from within the riser pipe 30 of the well 12, as necessary.

In the embodiment illustrated in FIG. 1, the pump assembly 54 can include one or more one-way valves such as those found in a single valve parallel gas displacement pump, double valve pump, bladder pump, electric submersible pump and other types of pumps (not shown in FIG. 1) that are utilized during a parallel gas displacement pumping of the first fluid 38 to the fluid receiver 18. The one way valve(s) allow the first fluid 38 to move from the first zone 26 toward the fluid outlet line 20, without the first fluid 38 moving in the opposite direction. These types of one-way valves can include poppet valves, reed valves, electronic and/or electromagnetic valves and check valves of any suitable type and/or configuration, for example. The gas inlet line 16 extends to the pump assembly 54, and the fluid outlet line 20 extends from the pump assembly 54. In this embodiment, because the environmental fluid level 42E is above the level of the sensor apparatus 52, the level of the first fluid 38 equilibrates at a somewhat similar level within the fluid outlet line 20 (as well as the gas inlet line 16) as the environmental fluid level 42E, until such time as the first fluid 38 is pumped or otherwise transported toward the surface region 32.

As explained in greater detail below, gas 46 from the gas source 14 is delivered down the gas inlet line 16 to the pump assembly 54 to force the first fluid 38 that has migrated to the pump assembly 54 during equilibration upward through the fluid outlet line 20 to the fluid receiver 18. With this design, the gas 46 does not cause any pressurization of the riser pipe 30, nor does the gas 46 utilize the riser pipe 30 during the pumping process. Stated another way, in this and other embodiments, the riser pipe 30 does not form any portion of the pump assembly 54. With this design, the need for high-pressure riser pipe 30 is reduced or eliminated. Further, gas consumption is greatly reduced because the riser pipe 30, which has a relatively large volume, need not be pressurized.

The pump assembly 54 can be coupled to the docking apparatus 50 so that removal of the docking apparatus 50 from the well 12 likewise results in simultaneous removal of the pump assembly 54 and/or the sensor apparatus 52 from the well 12. In the embodiment illustrated in FIG. 1, as well as in other embodiments described herein, the docking apparatus 50, the sensor apparatus 52 and/or the pump assembly 54 are positioned "in-line". As used herein, the term "in-line" is intended to be construed as structures being positioned in series, such that the structures are positioned one beneath another relative in a substantially vertical well 12, as illustrated in FIG. 1, for example. With this design, the sensor assembly 51 can be inserted into riser pipes 30 having smaller diameters, thereby reducing the volume of first fluid 38 within the first zone 26 that may need to be purged from the well 12, if required.

In operation, following installation of the well 12, fluid from the environment 11 enters the first zone 26 through the fluid inlet structure 29. Before the docking apparatus 50 is in the engaged position, the first zone 26 and the second zone 28 are in fluid communication with one another, thereby allowing the fluid to flow upwards and mix into the second zone while the fluid level is equilibrating within the well 12.

During a monitoring, sampling or testing process, the docking apparatus 50 is lowered into the well 12 down the riser pipe 30 until the docking apparatus 50 engages with the docking receiver 48. The resilient seal 58 forms a fluid-tight seal with the docking receiver 48 so that the first zone 26 and the second zone 28 are no longer in fluid communication with one another. At this point the fluid within the well becomes separated into the first fluid 38 and the second fluid 40.

In the embodiment illustrated in FIG. 1, as the level of the first fluid 38 rises, the sensor apparatus 52 begins receiving the first fluid 38. The sensor apparatus 52 can then begin determining relevant fluid properties of the first fluid 38, and can transmit this data to the controller 17 for further processing, if necessary. In certain embodiments, the controller 17 is included as part of the sensor assembly 51. In these and other embodiments, the controller 17 can analyze the data received from the sensor apparatus 52 to determine whether removal of some or all of the first fluid 38 may desired or required, e.g., for further testing. If removal of the first fluid 38 is to be performed, the controller 17 can activate the pump assembly 54 at an appropriate time to commence removal of the first fluid 38 from the well 12 or from the first zone 26, for example.

As the first fluid 38 continues to rise toward the pump assembly 54, the first fluid 38 remains isolated from the second fluid 40 because the pump assembly 54 is self-contained and does not rely on the riser pipe 30 as part of the structure of the pump assembly 54. In other words, the first fluid 38 within the pump assembly 54 does not contact the second fluid 40.

In certain embodiments, the controller 17 (or an operator of the system) can commence the flow of gas 46 from the gas source 14 to the pump assembly 54 to begin pumping the first fluid 38 through the fluid outlet line 20 to the fluid receiver 18, as described in greater detail below. Once a suitable volume of the first fluid 38 has been pumped to the fluid receiver 18, the controller 17 can stop the flow of gas 46, which effectively stops the pumping process. The pump assembly 54 can then refill with more fluid from the environment 11 (via the first zone 26), which can then be monitored, analyzed and/or removed for further testing as needed. Alternatively, the first fluid 38 can be analyzed by the sensor apparatus 52 in situ in the first zone 26, without the need for transporting the first fluid 38 through the fluid outlet line 20 to the fluid receiver 18. Alternatively, the process of purging the fluid can be immediately followed by sampling and/or testing the fluid with the controller 17, for example.

Because the volume of the first zone 26 is relatively small in comparison with the volume of the second zone 28, purging of the first fluid 38 from the first zone 26 can occur relatively rapidly. Further, because the first zone 26 is the sampling zone from which the first fluid 38 is collected, there is no need to purge or otherwise remove any of the second fluid 40 from the second zone 28. As long as the docking apparatus 50 remains in the engaged position, any fluid entering the first zone 26 will not be substantially influenced by or diluted with the second fluid 40.

Figure 2:
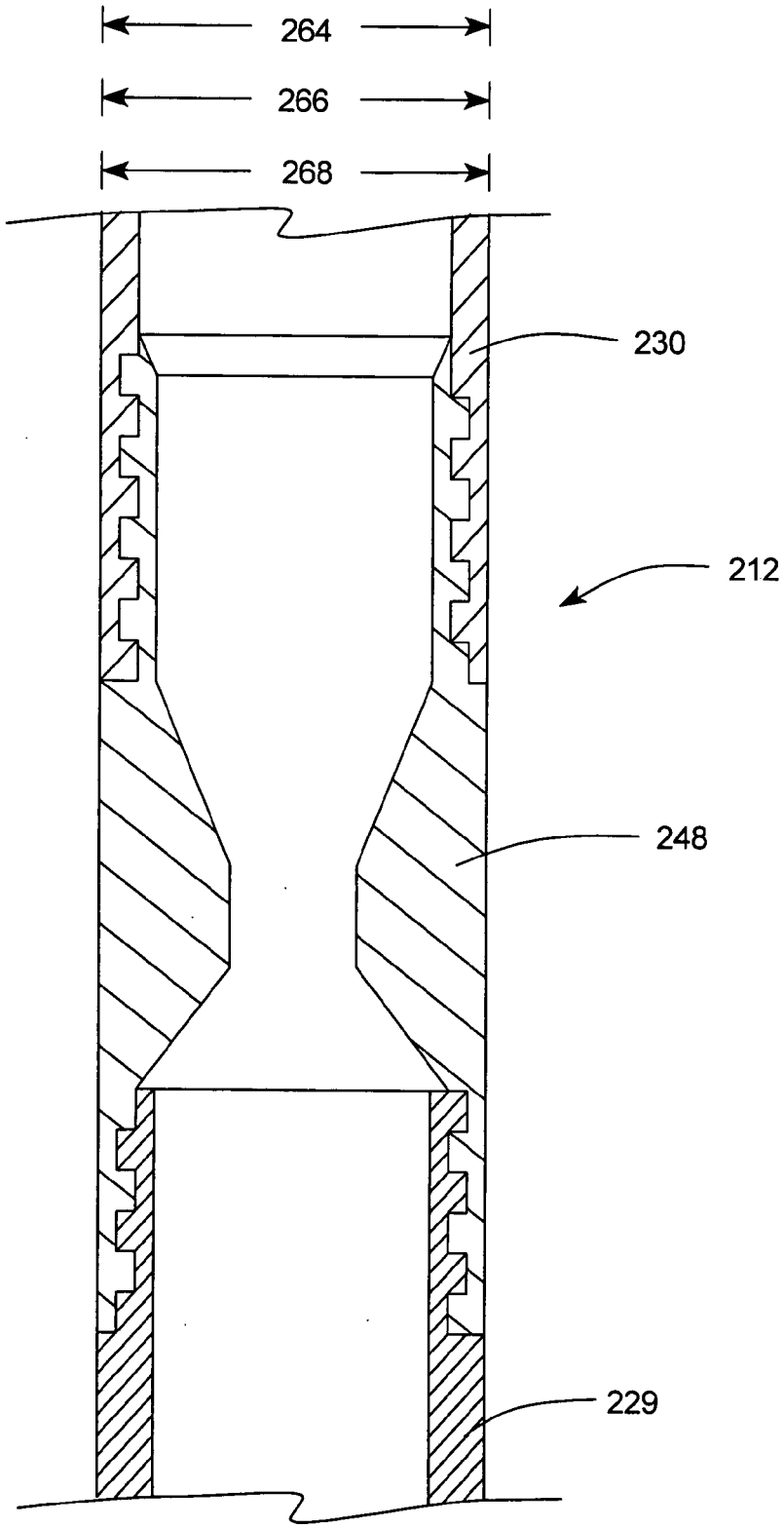
FIG. 2 is a cross-sectional view of a portion of one embodiment of a portion of the subsurface well, including a portion of a fluid inlet structure, a portion of a riser pipe and a docking receiver.

FIG. 2 is a detailed cross-sectional view of one embodiment of a portion of the subsurface well 212, including a portion of the fluid inlet structure 229, a portion of the riser pipe 230 and the docking receiver 248. In this embodiment, the docking receiver 248 is threadedly secured to the fluid inlet structure 229. Further, the riser pipe 230 is threadedly secured to the docking receiver 248. The docking receiver 248 is positioned between the fluid inlet structure 229 and the riser pipe 230. In alternative embodiments, the fluid inlet structure 229, the riser pipe 230 and/or the docking receiver 248 can be secured to one another by a different mechanism, such as by an adhesive material, welding, or any other suitable engagement means. Still alternatively, the fluid inlet structure 229, the riser pipe 230 and/or the docking receiver 248 can be formed or molded as a unitary structure, which may or may not include homogeneous materials.

The fluid inlet structure 229 has an outer diameter 264, the riser pipe 230 has an outer diameter 266, and the docking receiver 248 has an outer diameter 268. In this embodiment, the outer diameters 264, 266, 268 are substantially similar so that the outer casing of the well 212 has a standard form factor and is relatively uniform for easier installation. Alternatively, the outer diameters 264, 266, 268 can be different from one another.

Figure 3:
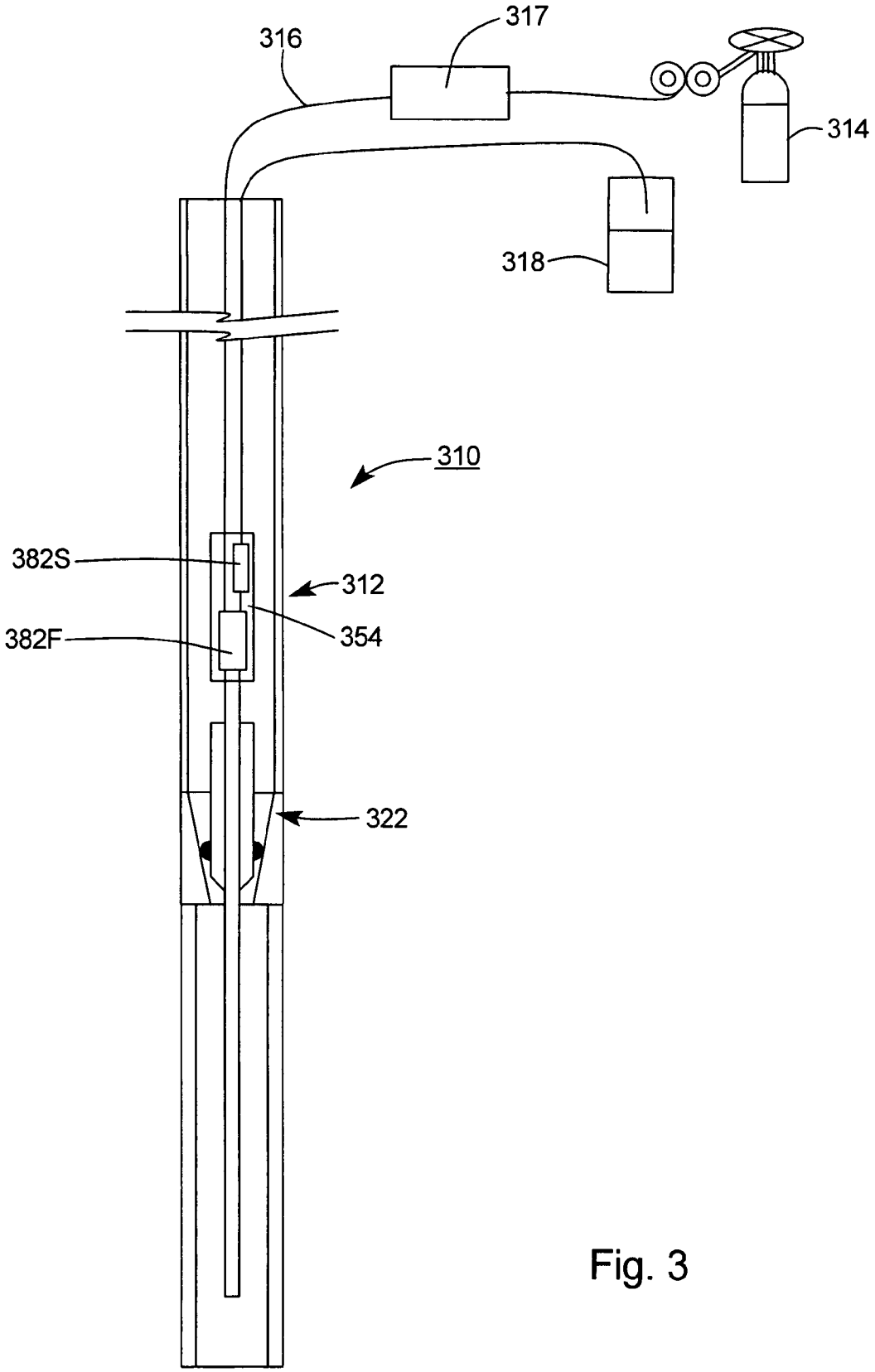
FIG. 3 is a schematic view of another embodiment of the fluid monitoring system.

FIG. 3 is a schematic view of another embodiment of the fluid monitoring system 310. In FIG. 3, the environment 11 (illustrated in FIG. 1) and the annular materials 24A-C (illustrated in FIG. 1) have been omitted for simplicity. In the embodiment illustrated in FIG. 3, the fluid monitoring system 310 includes components and structures that are somewhat similar to those previously described, including the subsurface well 312, the gas source 314, the gas inlet line 316, the controller 317, the fluid receiver 318, the fluid outlet line 320 and the zone isolation assembly 322. However, in this embodiment, the pump assembly 354 (described in greater detail below) of the zone isolation assembly 322 includes two one-way valves including a first valve 382F and a second valve 382S. The pump assembly 354 provides one or more advantages over other types of pump assemblies as set forth herein.

Figure 4:
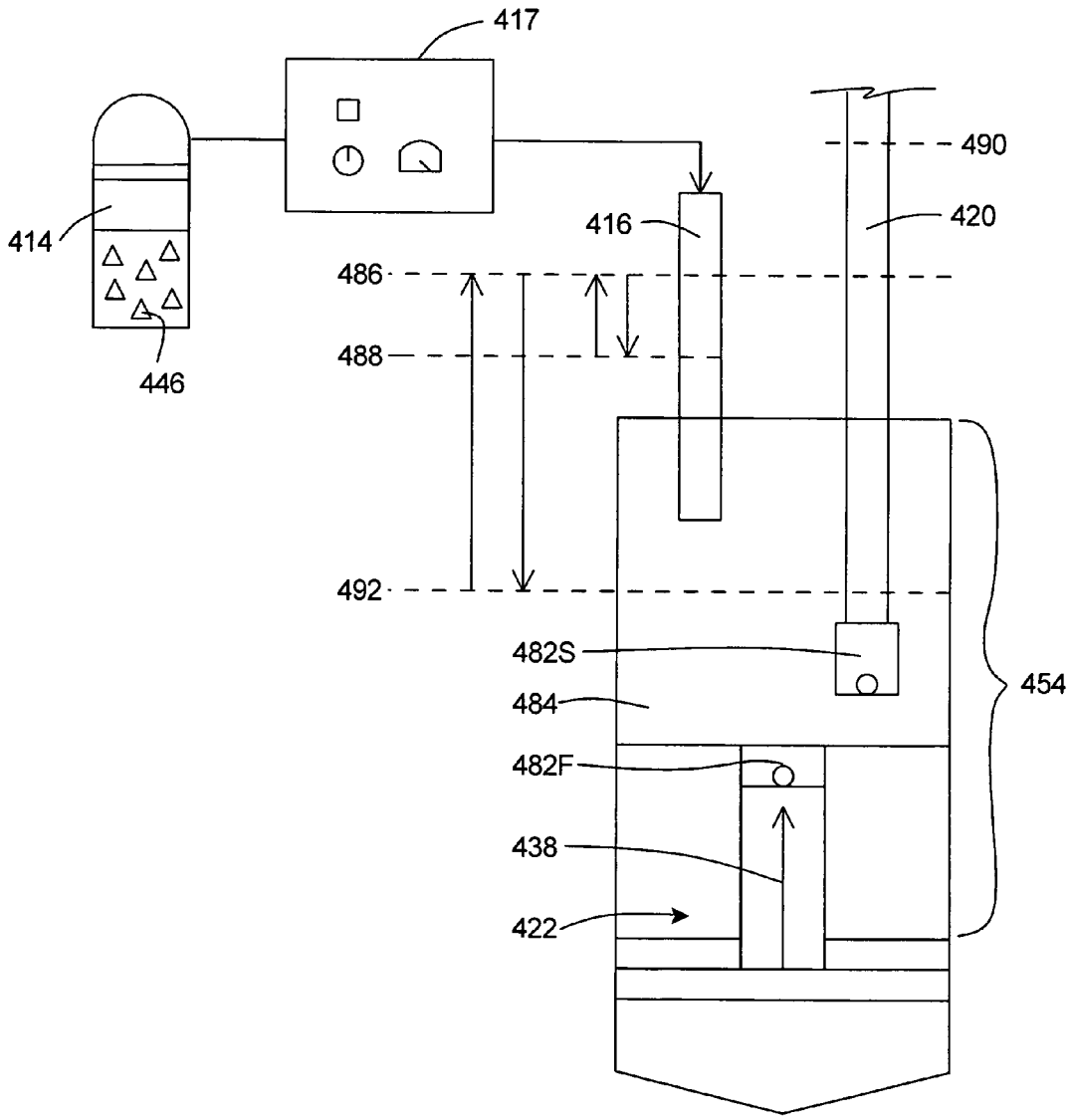
FIG. 4 is a schematic view of a portion of yet another embodiment of the fluid monitoring system including a pump assembly.

FIG. 4 is a schematic diagram of a portion of one embodiment of the fluid monitoring system 410 including a gas source 414, a gas inlet line 416, a controller 417, a fluid outlet line 420, a zone isolation assembly 422, and a pump assembly 454. The zone isolation assembly 422 functions in a substantially similar manner as previously described. More specifically, the first zone 26 (illustrated in FIG. 1) is isolated from the second zone 28 (illustrated in FIG. 1) so that the first fluid 438 can migrate or be drawn through the sensor apparatus 52 (illustrated in FIG. 1) into the pump assembly 454 without mixing with or becoming diluted by the second fluid 40 (illustrated in FIG. 1) in the second zone 28.

The specific design of the pump assembly 454 can vary. In this embodiment, the pump assembly 454 is a two-valve, two-line assembly. The pump assembly 454 includes a pump chamber 484, a first valve 482F, a second valve 482S, a portion of the gas inlet line 416 and a portion of the fluid outlet line 420. The pump chamber 484 can encircle one or more of the valves 482F, 482S and/or portions of the lines 416, 420.

The first valve 482F is a one-way valve that allows the first fluid (represented by arrow 438) to migrate or otherwise be transported from the first zone 26 into the pump housing 484. For example, the first valve 482F can be a check valve or any other suitable type of one-way valve that is open as the well fluid level 42W (illustrated in FIG. 1) equilibrates with the environmental fluid level 42E (illustrated in FIG. 1). As the level of the first fluid 438 rises, the first valve 482F is open, allowing the first fluid 438 to pass through the first valve 482F and into the pump chamber 484. However, if the level of the first fluid 438 begins to recede, the first valve 482F closes and inhibits the first fluid 438 from moving back into the first zone 26.

The second valve 482S can also be a one-way valve that operates by opening to allow the first fluid 438 into the fluid outlet line 420 as the level of the first fluid 438 rises within the pump chamber 484 due to the equilibration process described previously. However, any back pressure in the fluid outlet line 420 causes the second valve 482S to close, thereby inhibiting the first fluid 438 from receding from the fluid outlet line 420 back into the pump chamber 484.

Figure 5:
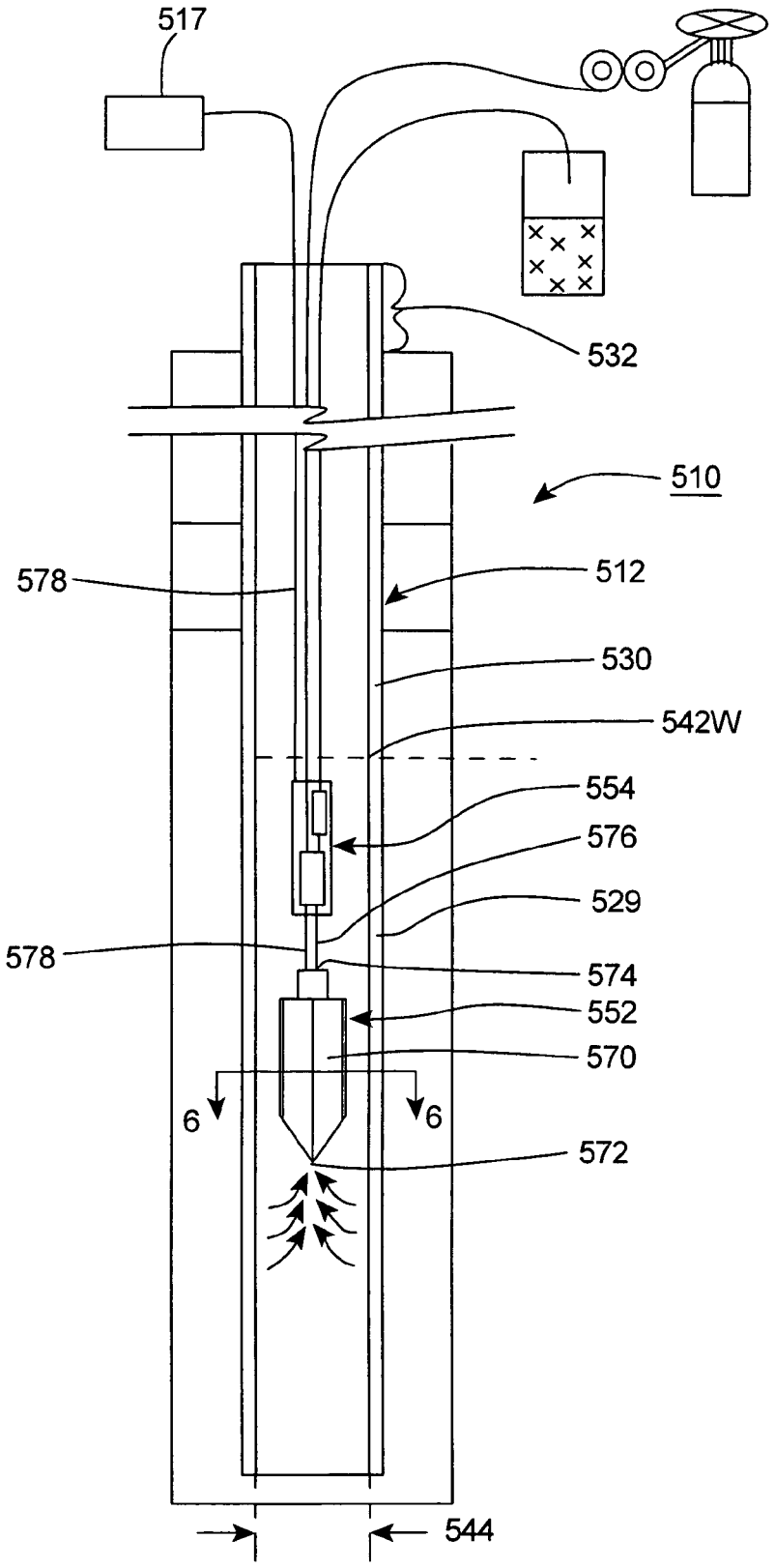
FIG. 5 is a schematic view of a portion of still another embodiment of the fluid monitoring system.

In certain embodiments, the first fluid 438 within the fluid outlet line 420 is systematically moved toward and into the fluid receiver 18 (illustrated in FIG. 1). In FIG. 5, two different embodiments for moving the first fluid 438 toward the fluid receiver 18 are illustrated. In the first embodiment, the first fluid 438 is allowed to equilibrate to an initial fluid level 486 in both the gas inlet line 416 and the fluid outlet line 420. The controller 417 (or an operator) then causes the gas 446 from the gas source 414 to move downward in the gas inlet line 416 to force the first fluid 438 to a second fluid level 488 in the gas inlet line 416. This force causes the first valve 482F to close, and because the first fluid 538 has nowhere else to move to, the first fluid 438 forces the second valve 482S to open to allow the first fluid 438 to move in an upwardly direction in the fluid outlet line 420 to a third fluid level 490 in the fluid outlet line 420.

The gas source 414 is then turned off to allow the level of the first fluid 438 in the gas inlet line 416 to equilibrate with the environmental fluid level 42E. The second valve 482S closes, inhibiting any change in the level of the first fluid 438 in the fluid outlet line 420. Once the first fluid 438 in the gas inlet line 416 has equilibrated with the environmental fluid level 42E, the process of opening the gas source 414 to move the gas 446 downward in the gas inlet line 416 is repeated. Each such cycle raises the level of the first fluid 438 in the fluid outlet line 420 until a desired amount of the first fluid 438 reaches the fluid receiver 18. The gas cycling in this embodiment can be utilized regardless of the time required for the first fluid 438 to equilibrate, but this embodiment is particularly suited toward a relatively slow equilibration process.

In the second embodiment illustrated in FIG. 4, a greater volume of gas 446 is used following equilibration of the first fluid to the initial fluid level 486. Thus, in this embodiment, instead of maintaining the gas 446 within the gas inlet line 416 during each cycle, the gas source 414 is opened until the first fluid 438 is forced downward, out of the gas inlet line 416 and downward in the pump chamber 484 to a fourth fluid level 492 within the pump chamber 484. As provided previously, when the gas 446 is forced downward into the pump chamber 484, the first valve 482F closes and the second valve 482S opens. This allows the first fluid 438 to move upward in the fluid outlet line 420 to a greater extent during each cycle. The gas source 414 is then closed, the first fluid within the pump chamber 484 and the gas inlet line 416 equilibrates, and the cycle is repeated until the desired volume of first fluid 438 is delivered to the fluid receiver 18. The cycling in this embodiment can be utilized regardless of the time required for the first fluid 438 to equilibrate, but this embodiment is particularly suited toward a relatively rapid equilibration process.

With these designs, because the gas 446 is cycled up and down within the gas inlet line 416 and or pump chamber 484, and no pressurization of the riser pipe 30 (illustrated in FIG. 1) is required, only a small volume of gas 446 is consumed, and the gas 446 is thereby conserved. Further, in this embodiment, the gas 446 does not come into contact with the first fluid 438 in the fluid outlet line 420. Consequently, potential VOC loss caused by contact between the gas 446 and the first fluid 438 can be inhibited or eliminated.

FIG. 5 is a schematic view of another embodiment of a fluid monitoring system 510 including a subsurface well 512. In this embodiment, the subsurface well 512 does not include the docking receiver 48 (illustrated in FIG. 1) or the docking apparatus 50 (illustrated in FIG. 1). Instead, as illustrated in FIG. 5, the subsurface well 512 includes a fluid inlet structure 529, a riser pipe 530 and a sensor assembly 551.

The sensor assembly 551 includes a sensor apparatus 552 and a pump assembly 554 coupled to the sensor apparatus 552 in an in-line manner. Stated another way, in this embodiment, the pump assembly 554 is positioned substantially directly between the sensor apparatus 552 and the surface region 532 of the well 512 in a direction that moves between the sensor apparatus 552 and the surface region 532 of the well 512. In one such embodiment, the sensor apparatus 552, the pump assembly 554 and the surface region 532 of the well 512 are arranged in a substantially collinear manner. It is recognized, however, that not all wells 512 are absolutely linear in configuration. For instance, some wells 512 can include riser pipes 530 that curve or bend. It is to be understood that as used herein, the term "in-line" is intended to be construed as consecutive or in series with one another. With this in-line design, the sensor assembly 551 can be positioned in wells 512 having relatively small inner diameters 544, i.e. less than approximately 1.50 inches, less than approximately 1.00 inches, or less than approximately 0.75 inches, as non-exclusive examples.

In one embodiment, the sensor assembly 551 is positioned at or below the well fluid level 542W. However, in alternative embodiments, only a portion of the sensor assembly 551 is positioned at or below the well fluid level 542W. For example, in one embodiment, the entire sensor apparatus 552 and only a portion of the pump assembly 554 are positioned below the well fluid level 542W. In still other embodiments, one of the sensor assembly 552 and the pump assembly 554 are positioned below the well fluid level 542W, while the other of the sensor assembly 552 and the pump assembly 554 is positioned entirely above the well fluid level 542W. In yet another embodiment, only a portion of one of the sensor apparatus 552 and the pump assembly 554 is positioned below the well fluid level 542W, while the other of the sensor apparatus 552 and the pump assembly 554 is positioned entirely above the well fluid level 542W.

In various embodiments, the activation of the pump assembly 554 draws fluid through the sensor apparatus 552 for determining one or more fluid properties of the fluid. In other embodiments, the pump assembly 554 can pump fluid through the sensor apparatus 552 for determining one or more fluid properties of the fluid, as described in greater detail below. The pump assembly 554 can pump the fluid only to the extent of moving at least partially through the sensor apparatus 552, or the pump assembly 554 can pump the fluid through the sensor apparatus 552 and further to the fluid receiver 518. Alternatively, the pump assembly 554 can pump the fluid through the sensor apparatus 552 and further to another structure of the fluid monitoring system 510.

In one embodiment, the sensor apparatus 552 has an apparatus housing 570 having one or more housing inlets 572 (only one housing inlet 572 is illustrated in FIG. 5), and one or more housing outlets 574 (only one housing outlet 574 is illustrated in FIG. 5). Each housing inlet 572 receives fluid into the apparatus housing 570 of the sensor apparatus 552. Once inside the apparatus housing 570, the fluid is either drawn, pushed or passively moves through the apparatus housing 570 toward the housing outlet 574. During movement of the fluid through the apparatus housing 570, one or more fluid properties are measured, sensed or otherwise determined, as explained in greater detail below.

Further, in this embodiment, the sensor assembly 551 can include a first conduit 576 and/or a second conduit 578. The first conduit 576 extends directly between the sensor apparatus 552 and the pump assembly 554. The first conduit 576 guides movement of the fluid between the sensor apparatus 552 and the pump assembly 554.

In the embodiment illustrated in FIG. 5, the second conduit 578 can extend between the sensor apparatus 552 and the controller 517 or other structure within or outside of the well 512. In this embodiment, the second conduit 578 can guide positioning of one or more signal transmitters (not shown), such as wires, cables, bundles, electrodes, sensors, fiber optics, etc., which can carry data or other signals to the controller 517 for processing.

In an alternative embodiment, only the first conduit 576 is used. In this embodiment, the fluid and the one or more signal transmitters can move, can be positioned, or can otherwise cohabitate within the first conduit 576, at least between the sensor apparatus 552 and the pump assembly 554. In still another embodiment, no conduit is used to guide positioning of the signal transmitter(s) between the sensor apparatus 552 and the pump assembly 554.

The pump assembly 554 can include any suitable type of pump. In the embodiment illustrated in FIG. 5, the pump assembly 554 can include a two line, two valve pump described previously herein. Alternatively, the pump assembly 554 can include a single valve parallel gas displacement pump, double valve pump, bladder pump, electric submersible pump and/or any other suitable type of pump.

Figure 6:
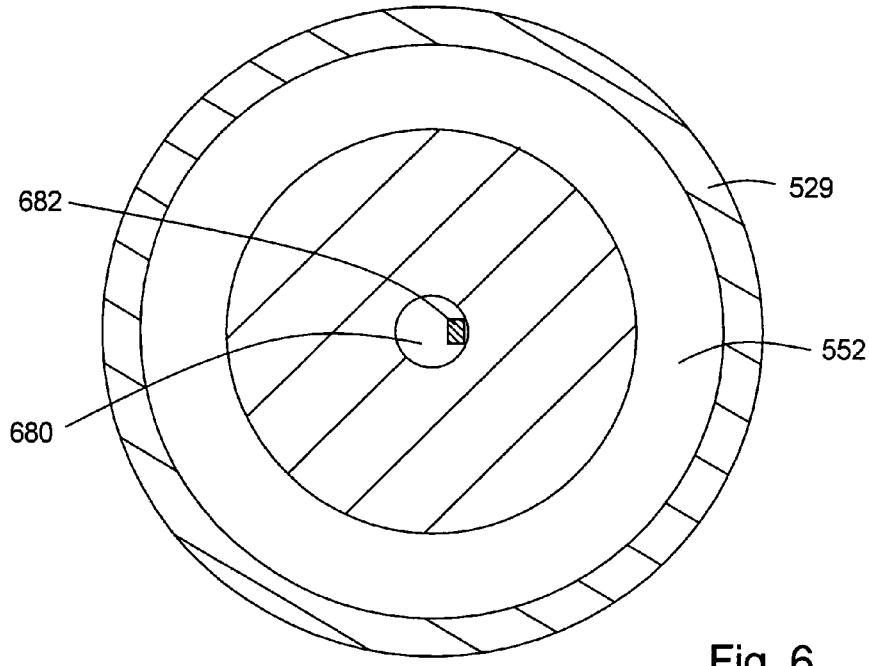
FIG. 6 is a cross-sectional view of a portion of the fluid monitoring system taken on line 6-6 in FIG. 5.

FIG. 6 is a cross-sectional view of the fluid inlet structure 529 and the sensor apparatus 552 taken on line 6-6 in FIG. 5. In this embodiment, the fluid travels through the sensor apparatus 552 via the apparatus inlet 572 (illustrated in FIG. 5), through one or more housing channels 680 (only one housing channel is present in the embodiment illustrated in FIG. 6) to the apparatus outlet 574 (illustrated in FIG. 5). The size and or positioning of the housing channels 680 can vary to suit the design requirements of the fluid monitoring system 10.

The sensor apparatus 552 includes one or more sensors 682 that sense or otherwise determine one or more fluid properties of the fluid and/or collect data relative to one or more fluid properties of the fluid, which can then be sent, relayed or otherwise transmitted to the controller 517 (illustrated in FIG. 5) for further processing, if required. The specific type of sensor(s) 682 included in the sensor apparatus can vary depending upon the requirements of the sensor assembly 551 (illustrated in FIG. 5) and/or the fluid monitoring system 10. For example, the sensor(s) 682 can include a series of electrodes, with each electrode being calibrated to sense a different fluid property of the fluid. In non-exclusive alternative embodiments, the sensor 682 can include a polymeric coded Fiber Bragg Grating sensor, an array of sensor filaments, an array of fiber optic nodes such as a fiber optic cable, or any other suitable type of sensor known to those skilled in the art. As the fluid passes through the housing channel 680, the fluid can come near and/or contact the sensor 682 as required by the sensor 682.

In one embodiment, because the fluid properties are sensed in situ, the sensor assembly 551 can be dynamically raised or lowered within the well 512 (illustrated in FIG. 5) as needed to test or compile relevant data regarding various fluid properties for fluid at specific locations or depths within the well 512. As a result, time can be saved because the fluid does not necessarily need to be transported to the fluid receiver 518 for analysis of specific fluid properties. Alternatively, the fluid can be transported to the fluid receiver for analysis.

Figure 7:
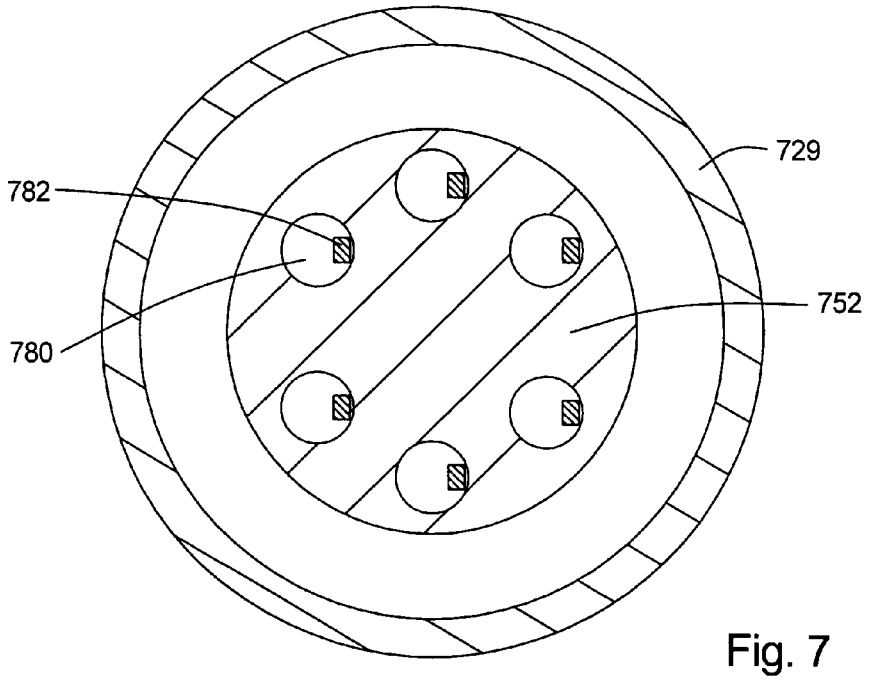
FIG. 7 is a cross-sectional view of another embodiment of a portion of a fluid monitoring system.

FIG. 7 is a cross-sectional view of a fluid inlet structure 729 and another embodiment of a sensor apparatus 752. In this embodiment, the sensor apparatus 752 can include a plurality of housing channels 780, with one or more sensors 782 residing within each housing channel 780. In one such embodiment, each housing channel 780 can include a distinct type of sensor that senses one particular fluid property of the fluid to be tested. Alternatively, a plurality of the same type of sensor can be used in order to cross-check the accuracy of the other similar sensors and/or compile a greater amount of data relative to one or more specific fluid properties. The plurality of housing channels 780 can remain separated throughout the sensor apparatus 752, or a plurality or all of the housing channels 780 can converge and merge into a single housing channel 780 as the housing channels 780 approach the housing outlet 574 (illustrated in FIG. 5, for example).

Figure 8:
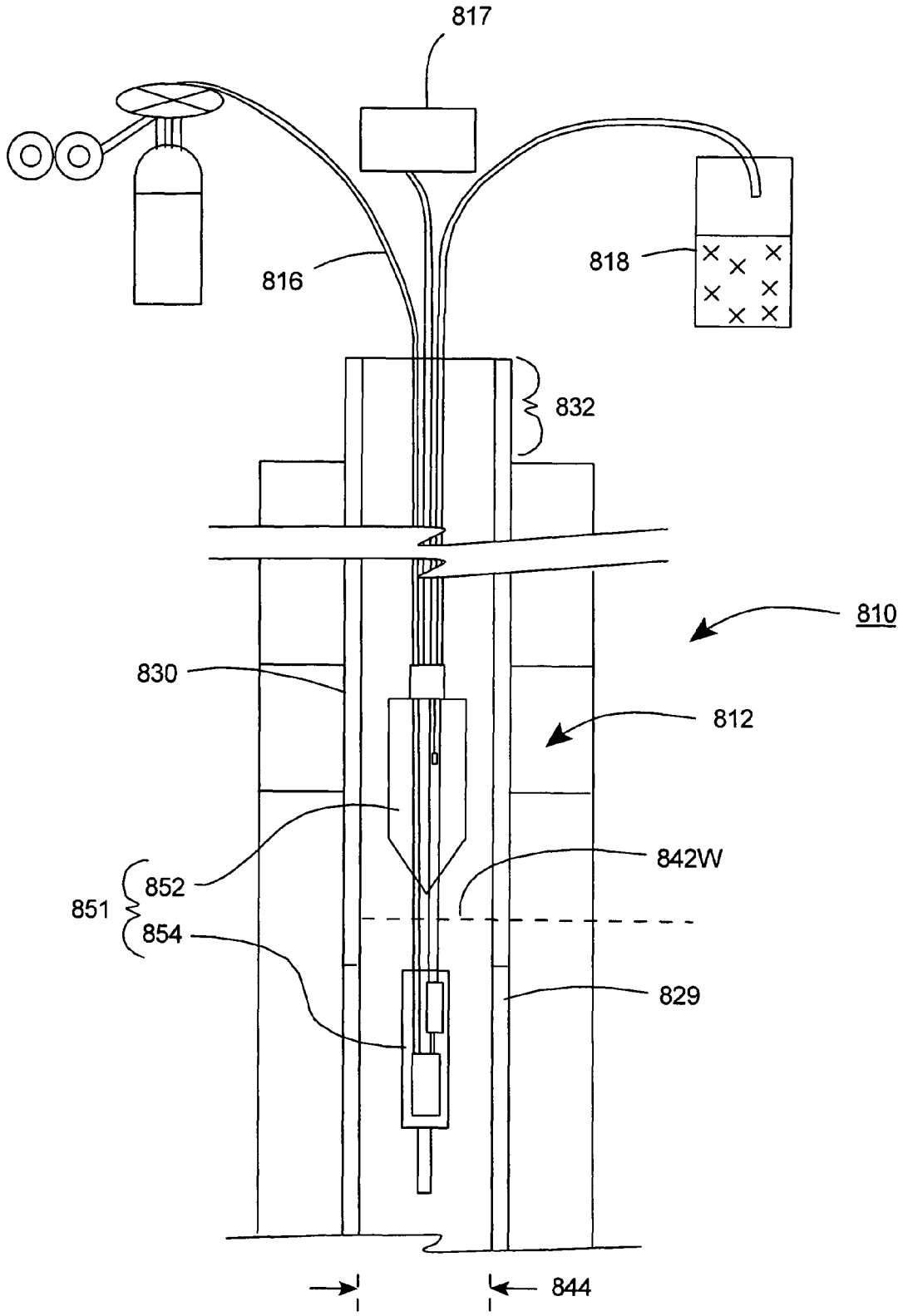
FIG. 8 is a schematic view of a portion of still another embodiment of the fluid monitoring system.

FIG. 8 is a schematic view of another embodiment of a fluid monitoring system 810 including a subsurface well 812. In this embodiment, the subsurface well 812 includes a fluid inlet structure 829, a riser pipe 830 and a sensor assembly 851. The sensor assembly 851 includes a sensor apparatus 852 and a pump assembly 854 coupled to the sensor apparatus 852 in an in-line manner. In this embodiment, the sensor apparatus 852 is positioned substantially directly between the pump assembly 854 and the surface region 832 of the well 812 in a direction that moves between the sensor apparatus 852 and the surface region 832 of the well 812. In one such embodiment, the pump assembly 854, the sensor apparatus 852 and the surface region 832 of the well 812 are arranged in a substantially collinear manner. With this in-line design, the sensor assembly 851 can be positioned in wells 812 having relatively small inner diameters 844, i.e. less than approximately 1.50 inches, less than approximately 1.00 inches, or less than approximately 0.75 inches, as non-exclusive examples.

In this embodiment, rather than the fluid being drawn into the sensor apparatus 852, activation of the pump assembly 854 pushes or pumps fluid through the sensor apparatus 852. The pump assembly 854 can pump the fluid only to the extent of moving at least partially through the sensor apparatus 852, or the pump assembly 854 can pump the fluid through the sensor apparatus 852 and further to the fluid receiver 818. Alternatively, the pump assembly 854 can pump the fluid through the sensor apparatus 882 and further to another structure of the fluid monitoring system 810, as required by the system 810.

Further, in this embodiment, fluid monitoring system 810 includes a gas inlet line 816 similar to that described previously herein. However, in this embodiment, the gas inlet line 816 can either be positioned to travel through the sensor apparatus 852, or to bypass or detour around the sensor apparatus 852.

In one embodiment, the entire sensor assembly 851 is positioned at or below the well fluid level 842W. However, in the embodiment illustrated in FIG. 8, only the pump assembly 854 is positioned at or below the well fluid level 842W. Because the pump assembly 854 is effectively pushing the fluid to the sensor apparatus 852, the sensor apparatus 852 does not need to be fully or even partially submerged below the well fluid level 842W to receive the fluid for sensing. Once the fluid has been sensed with the sensor apparatus 852, the sensor apparatus 852 can transmit fluid property data to the controller 817 for further processing and/or analysis, as required by the fluid monitoring system 810. With this design, the sensor apparatus 852 can be positioned at or near the surface region 832 for easier accessibility, for example. Alternatively, the sensor apparatus 852 can be positioned near the pump assembly 854.

It is recognized that the various embodiments illustrated and described herein are representative of various combinations of features that can be included in the fluid monitoring system 10 and/or the zone isolation assemblies 22 and/or the sensor assemblies 51. However, numerous other, embodiments have not been illustrated and described as it would be impractical to provide all such possible embodiments herein. It is to be understood that an embodiment of the sensor assembly 51, for example, can combine the sensor apparatus 52 and the pump assembly 54 within a single housing structure, as opposed to separate housing structures for each of the sensor apparatus 52 and the pump assembly 54 within the well 12. No limitations are intended by not specifically illustrating and describing any particular embodiment.

While the particular fluid monitoring systems 10 and sensor assemblies 51 as herein shown and disclosed in detail are fully capable of obtaining the objects and providing the advantages herein before stated, it is to be understood that they are merely illustrative of various embodiments of the invention. No limitations are intended to the details of construction or design herein shown other than as described in the appended claims.

What is claimed is:

1. A fluid monitoring system for monitoring one or more fluid properties of a fluid in a subsurface well having a well fluid level, the subsurface well including a surface region and a riser pipe that extends in a downwardly direction from the surface region, the fluid monitoring system comprising:

a sensor apparatus positioned within the subsurface well, the sensor apparatus including a sensor that senses one of the fluid properties of the fluid;

a pump assembly that is mechanically connected to and spaced apart from the sensor apparatus, the pump assembly being positioned within the subsurface well and substantially between the sensor apparatus and the surface region, the pump assembly being adapted to (i) pump the fluid so that the sensor can sense one or more fluid properties of the fluid, and (ii) pump the fluid past the surface region via a fluid outlet line; and a zone isolation assembly including (i) a docking receiver that is coupled to the riser pipe, and (ii) a docking apparatus that is coupled to the sensor apparatus, the docking apparatus moving from a disengaged position with the docking receiver to an engaged position with the docking receiver by the force of gravity.

2. The fluid monitoring system of claim 1 wherein the pump assembly is positioned in an inline manner with the sensor apparatus.

3. The fluid monitoring system of claim 1 further comprising a fluid receiver that receives the fluid, the pump assembly pumping the fluid to the fluid receiver, and wherein the fluid receiver is positioned outside the riser pipe past the surface region.

4. The fluid monitoring system of claim 1 further comprising a controller that receives data from the sensor regarding one of the fluid properties of the fluid while the sensor is positioned within the subsurface well.

5. The fluid monitoring system of claim 1 wherein one of the fluid properties is selected from the group consisting of an electrical property, an optical property, an acoustical property, a chemical property and a hydraulic property.

6. A fluid monitoring system for monitoring one or more fluid properties of a fluid in a subsurface well having a well fluid level, the subsurface well including a surface region and a riser pipe that extends in a downwardly direction from the surface region, the fluid monitoring system comprising:

a docking receiver that is fixedly secured to the riser pipe;

a docking apparatus that selectively docks with the docking receiver;

a sensor apparatus positioned within the subsurface well, the sensor apparatus including a sensor that senses one of the fluid properties of the fluid, the sensor apparatus being secured to the docking apparatus; and a pump assembly that is directly connected to the docking apparatus and mechanically connected to the sensor apparatus, the pump assembly being positioned within the subsurface well, the pump assembly being adapted to (i) pump the fluid so that the sensor can sense one or more fluid properties of the fluid, and (ii) pump the fluid past the surface region via a fluid outlet line.

7. The fluid monitoring system of claim 6 wherein the pump assembly is adapted to draw fluid from outside the sensor apparatus to proximate the sensor so that the sensor can sense one or more of the fluid properties of the fluid.

8. The fluid monitoring system of claim 6 wherein the sensor apparatus is positioned substantially between the pump assembly and the surface region.

9. The fluid monitoring system of claim 8 wherein the sensor apparatus is positioned above the well fluid level within the subsurface well.

10. The fluid monitoring system of claim 6 wherein the pump assembly includes a two-line, two-valve pump.

11. The fluid monitoring system of claim 6 wherein the pump assembly includes an electric submersible pump.

12. The fluid monitoring system of claim 6 wherein the pump assembly includes a bladder pump.

13. The fluid monitoring system of claim 6 wherein the sensor includes a Fiber Bragg Grating sensor.

14. The fluid monitoring system of claim 6 wherein at least a portion of the pump assembly is positioned below the well fluid level within the subsurface well.

15. The fluid monitoring system of claim 6 wherein the pump assembly is adapted to draw fluid from outside the sensor apparatus to proximate the sensor so that the sensor can sense one or more of the fluid properties of the fluid.

16. The fluid monitoring system of claim 6 wherein the fluid is groundwater.

17. The fluid monitoring system of claim 6 wherein the docking apparatus includes a fluid channel, the fluid moving through the fluid channel toward the surface region, the pump assembly being directly connected to the fluid channel.

18. The fluid monitoring system of claim 6 wherein the pump assembly is positioned substantially between the sensor apparatus and the surface region, and wherein at least a portion of the pump assembly is positioned below the well fluid level within the subsurface well.

19. The fluid monitoring system of claim 6 further comprising a fluid receiver that receives the fluid, the pump assembly pumping the fluid to the fluid receiver, and wherein the fluid receiver is positioned outside the riser pipe past the surface region.

20. The fluid monitoring system of claim 6 further comprising a controller that receives data from the sensor regarding one of the fluid properties of the fluid while the sensor is positioned within the subsurface well.

21. The fluid monitoring system of claim 6 wherein one of the fluid properties is selected from the group consisting of an electrical property, an optical property, an acoustical property, a chemical property and a hydraulic property.

22. The fluid monitoring system of claim 6 wherein the pump assembly is positioned in an inline manner with the sensor apparatus.

23. A fluid monitoring system for monitoring one or more fluid properties of a fluid in a subsurface well having a well fluid level, the subsurface well including a surface region and a riser pipe that extends in a downwardly direction from the surface region, the fluid monitoring system comprising:

a docking receiver that is fixedly secured to the riser pipe;

a docking apparatus that selectively docks with the docking receiver;

a sensor apparatus positioned within the subsurface well, the sensor apparatus including a sensor that senses one of the fluid properties of the fluid, the sensor apparatus being secured to the docking apparatus;

a fluid receiver that receives the fluid, the fluid receiver being positioned outside the riser pipe past the surface region; and a pump assembly that is directly connected to the docking apparatus and mechanically connected to and spaced apart from the sensor apparatus, the pump assembly being positioned within the subsurface well in an in-line manner with the sensor apparatus and substantially between the sensor apparatus and the surface region, at least a portion of the pump assembly being positioned below the well fluid level within the subsurface well, the pump assembly being adapted to (i) pump the fluid so that the sensor can sense one or more fluid properties of the fluid, and (ii) pump the fluid past the surface region via a fluid outlet line.

24. The fluid monitoring system of claim 23 further comprising a controller that receives data from the sensor regarding one of the fluid properties of the fluid while the sensor is positioned within the subsurface well.

25. The fluid monitoring system of claim 23 wherein one of the fluid properties is selected from the group consisting of an electrical property, an optical property, an acoustical property, a chemical property and a hydraulic property.

26. The fluid monitoring system of claim 23 wherein the pump assembly is adapted to draw fluid from outside the sensor apparatus to proximate the sensor so that the sensor can sense one or more of the fluid properties of the fluid.

* * * * *